US009276365B2

(12) United States Patent
Yu et al.

(10) Patent No.: US 9,276,365 B2
(45) Date of Patent: Mar. 1, 2016

(54) ELECTRICAL CONNECTOR WITH GROUNDING MECHANISM CONTACTING OUTER SHELL

(71) Applicant: ALLTOP ELECTRONICS (SUZHOU) LTD., Taicang (CN)

(72) Inventors: Wang-I Yu, Jhonghe (TW); Mao-Jung Huang, Jhonghe (TW); Li-Li Liang, Jhonghe (TW); Yong-Gang Zhang, Jhonghe (TW); Kun Liu, Jhonghe (TW)

(73) Assignee: ALLTOP ELECTRONICS (SUZHOU) LTD., Taicang, Jiangsu Province (CN)

( * ) Notice: Subject to any disclaimer, the term of this patent is extended or adjusted under 35 U.S.C. 154(b) by 0 days.

(21) Appl. No.: 14/552,712

(22) Filed: Nov. 25, 2014

(65) Prior Publication Data

US 2015/0364883 A1 Dec. 17, 2015

(30) Foreign Application Priority Data

Jun. 11, 2014 (CN) ..... 2014 2 0308487 U
Sep. 3, 2014 (CN) ..... 2014 1 0445078

(51) Int. Cl.
*H01R 9/03* (2006.01)
*H01R 24/70* (2011.01)
*H01R 13/6587* (2011.01)
*H01R 13/6594* (2011.01)

(52) U.S. Cl.
CPC ..... *H01R 24/70* (2013.01); *H01R 13/6587* (2013.01); *H01R 13/6594* (2013.01)

(58) Field of Classification Search
CPC ..... H01R 13/6581; H01R 13/6587; H01R 13/6591; H01R 13/6594
USPC ..... 439/79, 607.27, 607.35, 660
See application file for complete search history.

(56) References Cited

U.S. PATENT DOCUMENTS 7,922,534 B2 * 4/2011 Lin ..... H01R 13/64 439/544
8,360,808 B2 * 1/2013 Tsuchiya ..... H01R 13/6594 439/607.27
8,636,545 B2 * 1/2014 Chow ..... H01R 13/514 439/607.27
8,968,033 B2 * 3/2015 Little ..... H01R 13/6581 439/607.35
8,979,584 B2 * 3/2015 Tsuchiya ..... H01R 12/724 439/607.27

* cited by examiner

*Primary Examiner* — Khiem Nguyen
(74) *Attorney, Agent, or Firm* — Sughrue Mion, PLLC

(57) ABSTRACT

An electrical connector includes an upper contact module, a lower contact module, an outer insulative housing inject-molded with the upper contact module and the lower contact module, a shielding mechanism at least partly fixed in the outer insulative housing and a metallic outer shell enclosing the outer insulative housing. The upper contact module includes a number of upper contacts and an upper housing inject-molded with the upper contacts. The lower contact module includes a number of lower contacts and a lower housing inject-molded with the lower contacts. The shielding mechanism and the metallic outer shell are in mechanical contact with each other for achieving a relative larger grounding area.

19 Claims, 12 Drawing Sheets

ELECTRICAL CONNECTOR WITH GROUNDING MECHANISM CONTACTING OUTER SHELL

CROSS REFERENCE TO RELATED APPLICATIONS

The present application claims the priority of Chinese patent application Ser. No. 201410257239.7 filed Jun. 11, 2014 in the SIPO (Sate Intellectual Property Office of the P.R.C.), which is incorporated by reference herein in its entirety.

BACKGROUND

1. Technical Field

The present disclosure relates to an electrical connector, and more particularly to an electrical connector having an improved grounding mechanism for realizing robust grounding effect.

2. Description of Related Art

A conventional I/O connector for being mounted to a circuit board usually includes an insulative housing, a plurality of contacts retained in the insulative housing and an outer shell enclosing the insulative housing. The insulative housing usually includes a base and a tongue portion extending from the base. Since the tongue portion is usually thinner than the base, the strength of the tongue portion maybe not strong enough. The contacts may include a group of first contacts located at a top side of the tongue portion and a group of second contacts located at a bottom side of the tongue portion. Since the first contacts and the second contacts are adjacent with each other, signal interference generated therebetween may render poor signal transmission quality.

Hence, it is desirable to provide an electrical connector with robust grounding effect to improve signal transmission quality.

SUMMARY

The present disclosure provides an electrical connector including an upper contact module, a lower contact module, an outer insulative housing inject-molded with the upper contact module and the lower contact module, a shielding mechanism at least partly fixed in the outer insulative housing and a metallic outer shell enclosing the outer insulative housing. The upper contact module includes a plurality of upper contacts and an upper housing inject-molded with the upper contacts. The lower contact module includes a plurality of lower contacts and a lower housing inject-molded with the lower contacts. The shielding mechanism and the metallic outer shell are in mechanical contact with each other for achieving a relative larger grounding area.

The foregoing has outlined rather broadly the features and technical advantages of the present disclosure in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF ILLUSTRATED EMBODIMENTS

Figure 1:
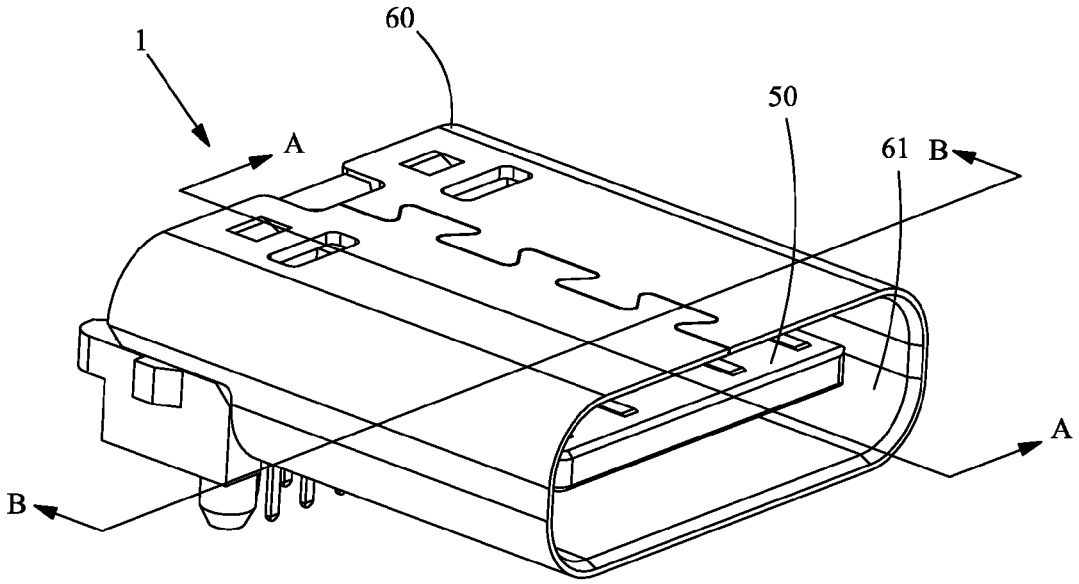
FIG. 1 is a perspective view of an electrical connector in accordance with a first embodiment of the present disclosure.

Reference will now be made to the drawing figures to describe the embodiments of the present disclosure in detail. In the following description, the same drawing reference numerals are used for the same elements in different drawings.

Figure 2:
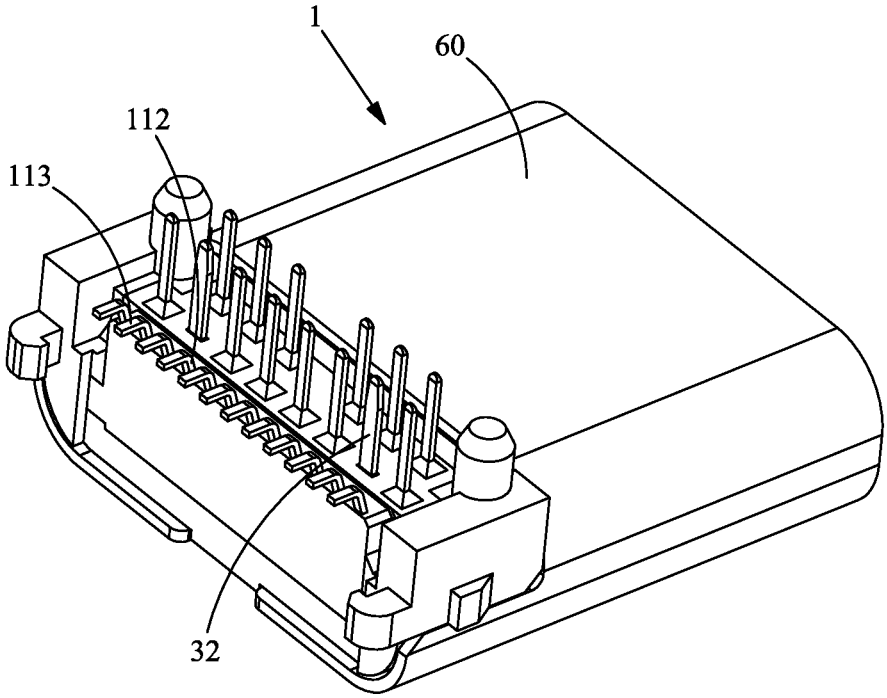
FIG. 2 is another perspective view of the electrical connector shown in FIG. 1.
Figure 3:
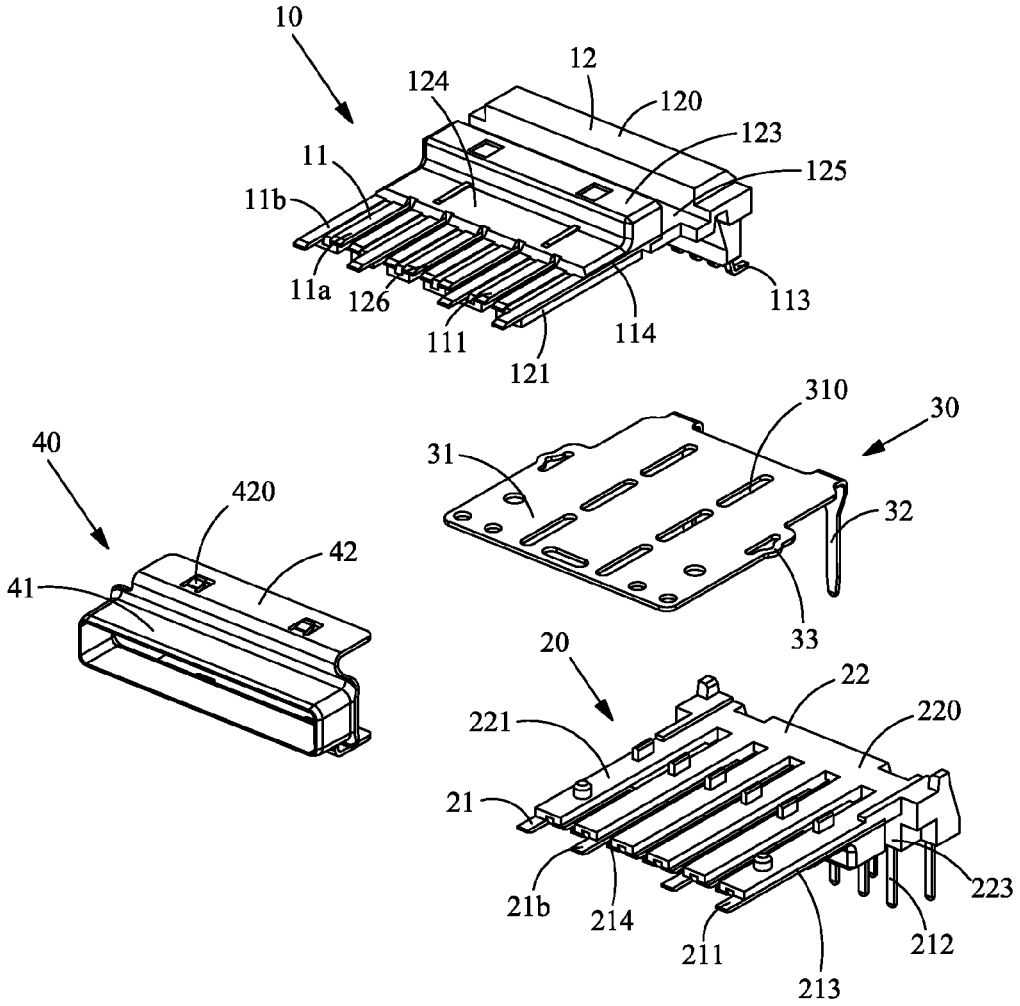
FIG. 3 is an exploded view of the electrical connector shown in FIG. 1 with an outer shell removed therefrom.
Figure 4:
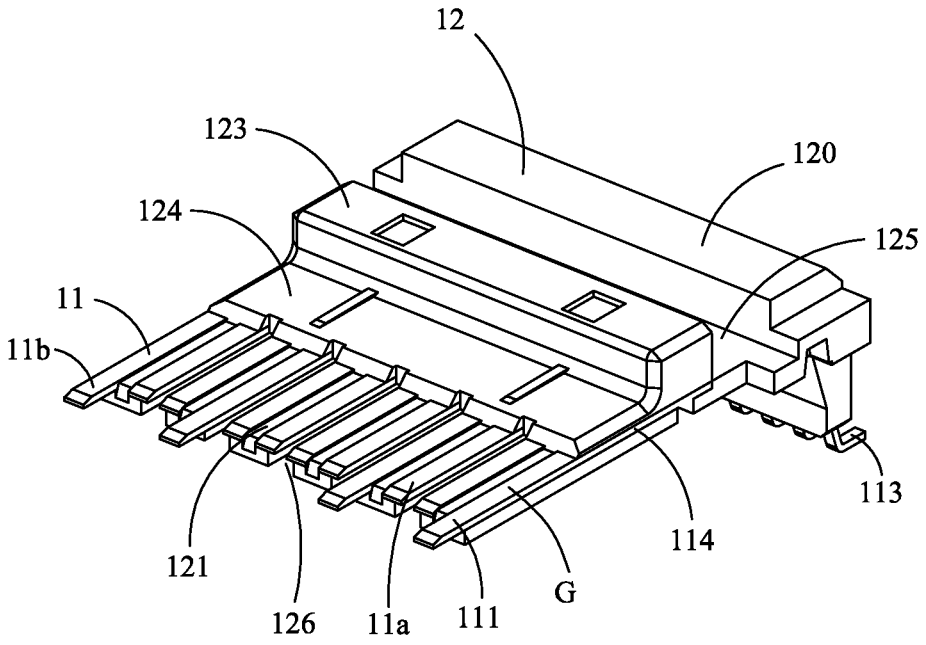
FIG. 4 is a perspective view of an upper contact module.
Figure 5:
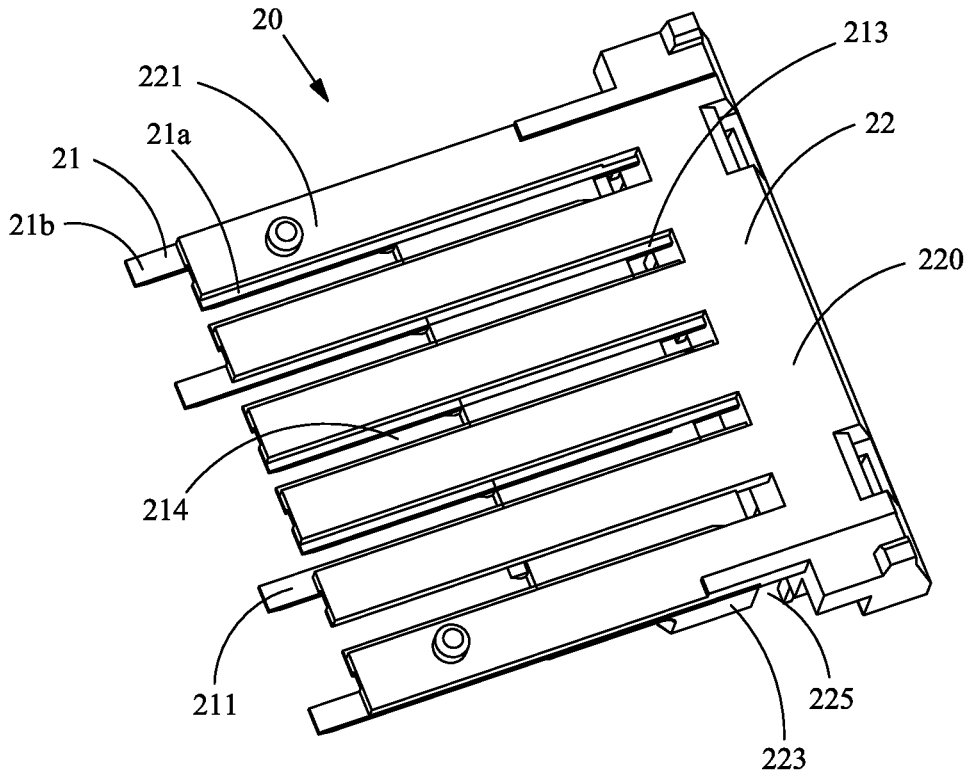
FIG. 5 is a perspective view of a lower contact module.
Figure 6:
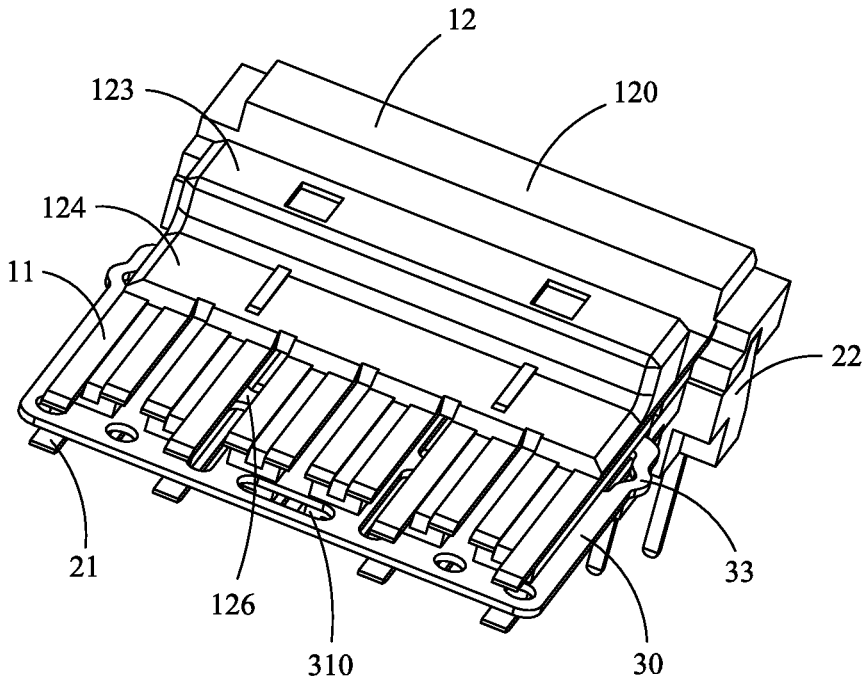
FIG. 6 is a perspective view showing that a grounding mechanism positioned between the upper contact module and the lower contact module.

Referring to FIGS. 1 to 3, the present disclosure discloses an electrical connector 1 capably of being mounted to a circuit board (not shown) for receiving a plug connector (not shown). The electrical connector 1 includes an upper contact module 10, a lower contact module 20, an outer insulative housing 50 inject-molded over the upper and the lower contact modules 10, 20, a metallic inner shell 40 and a metallic outer shell 60 fixed in the outer insulative housing 50, and a grounding mechanism fixed in the outer insulative housing 50.

Referring to FIGS. 3, 4 and 6-10, the upper contact module 10 includes a plurality of upper contacts 11 and an upper housing 12 inject-molded with the upper contacts 11. According to the illustrated embodiment of the present disclosure, the number of the upper contacts 11 is twelve. Of course, the number can be changed according to different design requirements.

The upper contacts 11 are arranged in a side-by-side manner. Each upper contact 11 includes an upper contacting portion 111 exposed to the air for mating with the plug connector, a slant portion 112 extending slantwise from the upper contacting portion 111, an upper soldering portion 113 extending horizontally from the slant portion 112, and an upper connecting portion 114 connected between the upper contacting portion 111 and the slant portion 112. The upper soldering portions 113 are so-called SMT types and are arranged in a single row for being easily soldered onto a circuit board.

The upper contacts 11 include a plurality of first contacts 11 a for transmitting signal or power (also known as signal contacts or power contacts, respectively), and a plurality of second contacts 11*b* for grounding (also known as ground contacts). In a single row, the first contacts 11*a* are located between the second contacts 11*b*. Two grounding contacts G of the second contact 11*b* are located at outmost lateral sides. In a single row, according to the illustrated embodiment of the present disclosure, the first contacts 11*a* include three pairs of differential signal contacts and some power contacts.

The upper housing 12 includes an upper base portion 120 and an upper tongue portion 121 extending forwardly from the upper base portion 120. The thickness of the upper base portion 120 is larger than the upper tongue portion 121. The upper base portion 120 includes a rear portion 123 and a front portion 124 connected between the upper tongue portion 121 and the rear portion 123. The front portion 124 is thicker than the upper tongue portion 121. The upper base portion 120 includes a depression 125. The upper contact module 10 defines a plurality of upper slots 126 extending therethrough along a vertical direction. The upper slots 126 extend forwardly through the upper housing 12. Each upper slot 126 is located between a pair of upper contacts 11. Under this design, for one hand, the upper contacts 11 can be supported by the upper housing 12 when a first injecting mold is completed; for the other hand, a relative large injecting runner can be formed in order to provide a relative large flowing area for better insert molding the outer insulative housing 50 afterwards.

Referring to FIGS. 3, 5 and 6 to 10, the lower contact module 20 includes a plurality of lower contacts 21 and a lower housing 22 inject-molded with the lower contacts 21. According to the illustrated embodiment of the present disclosure, the number of the lower contacts 21 is twelve. Of course, the number can be changed according to different design requirements.

The lower contacts 21 are arranged in a side-by-side manner. Each lower contact 21 includes a lower contacting portion 211 exposed to the air for mating with the plug connector, a lower soldering portion 212 bent downwardly for being mounted to the circuit board, and a lower connecting portion 213 connected between the lower contacting portion 211 and the lower soldering portion 212. The lower soldering portions 212 are so-called Through Hole types and are arranged in two rows for being soldered through the circuit board. Of course, the arrangement of the upper soldering portions 113 and the lower soldering portions 212 can be designed in other types according to different requirements. For example, the lower soldering portions 212 can also be arranged in a single row and/or the lower soldering portions 212 can also be designed in SMT types.

The lower contacts 21 include a plurality of third contacts 21*a* for transmitting signal or power (also known as signal contacts or power contacts, respectively), and a plurality of fourth contacts 21*b* for grounding (also known as ground contacts). Among the lower contacts 21, the fourth contacts 21*b* are located at opposite sides thereof for easily getting in contact with the outer shell 60 in order to reduce signal interference. In a single row, the third contacts 21*a* are located between the fourth contacts 21*b*. Two grounding contacts G of the second contact 21*b* are located at outmost lateral sides. In a single row, according to the illustrated embodiment of the present disclosure, the third contacts 21*a* include three pairs of differential signal contacts and some power contacts.

The lower housing 22 includes a lower base portion 220 and a lower tongue portion 221 extending forwardly from the lower base portion 220. The thickness of the lower base portion 220 is larger than the lower tongue portion 221. The lower base portion 220 includes a rear portion 223 and a front portion 224 connected between the lower tongue portion 221 and the rear portion 223. The front portion 224 is thicker than the lower tongue portion 221. The lower base portion 220 includes a depression 225. The lower contact module 20 defines a plurality of lower slots 214 extending therethrough along the vertical direction. The lower slots 214 extend forwardly through the lower housing 22. Each lower slot 214 is located between a pair of lower contacts 21. Under this design, for one hand, the lower contacts 21 can be supported by the lower housing 22 when a first injecting mold is completed; for the other hand, a relative large injecting runner can be formed in order to provide a relative large flowing area for better insert molding the outer insulative housing 50 afterwards. According to the illustrated embodiment of the present disclosure, the upper contacting portions 111 and the lower contacting portions 211 are of the same type while in a reversed arrangement in order that the plug connector can be inserted into the electrical connector 1 either in a normal insertion or in a reverse insertion.

Referring to FIGS. 2, 3, 6, 7, 9 and 10, the grounding mechanism includes a metallic shielding plate 30 stamped from a metal sheet and located between the upper contact module 10 and the lower contact module 20 for reducing signal interference between the upper contacts 11 and the lower contacts 12. The shielding plate 30 includes a flat body portion 31 and a pair of soldering legs 32 extending downwardly from the body portion 31 for being soldered to the circuit board. The shielding plate 30 can also reinforce the strength of the outer insulative housing 50. The body portion 31 includes a pair of deformable protrusions 33 on lateral sides thereof.

The width of the body portion 31 is larger than the upper and the lower contact modules 10, 20. As a result, the body portion 31 extends sidewardly beyond the upper and the lower contact modules 10, 20. The deformable protrusions 33 are capable of contacting either the inner shell 40 or the outer shell 30 for grounding. Besides, the body portion 31 extends forwardly beyond the upper housing 12 and the lower housing 22.

The body portion 31 includes a plurality of middle slots 310 in alignment with the upper slots 126 and the lower slots 214. As a result, when inject-molding the outer insulative housing 50, the flowing plastic can easily flow through the upper slots 126, the middle slots 310 and the lower slots 214.

Figure 7:
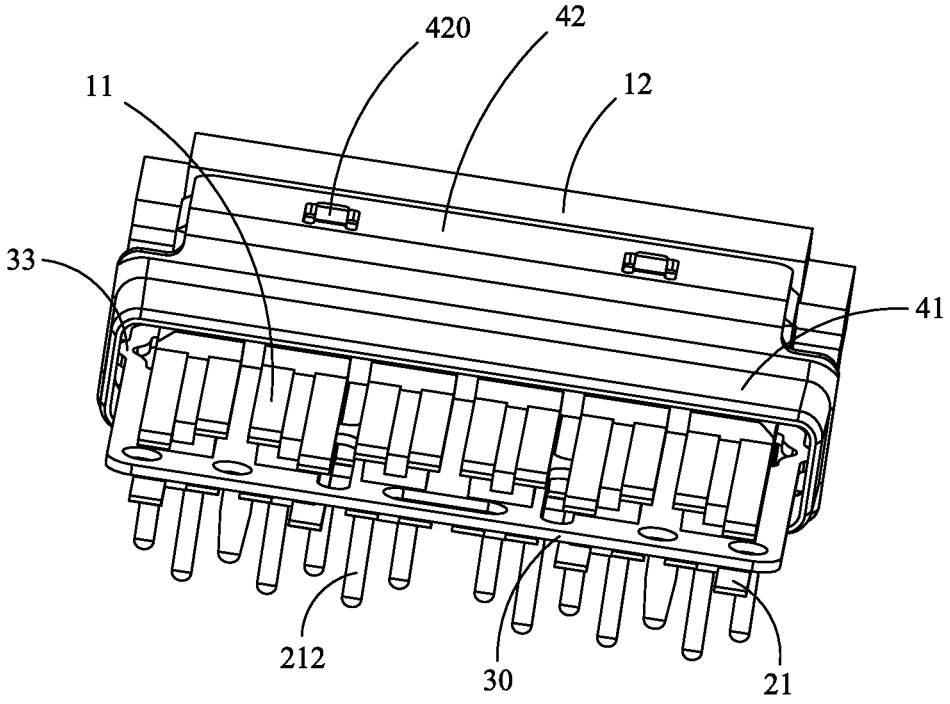
FIG. 7 is a partly assembled view showing an inner shell attached to the upper contact module and the lower contact module.
Figure 8:
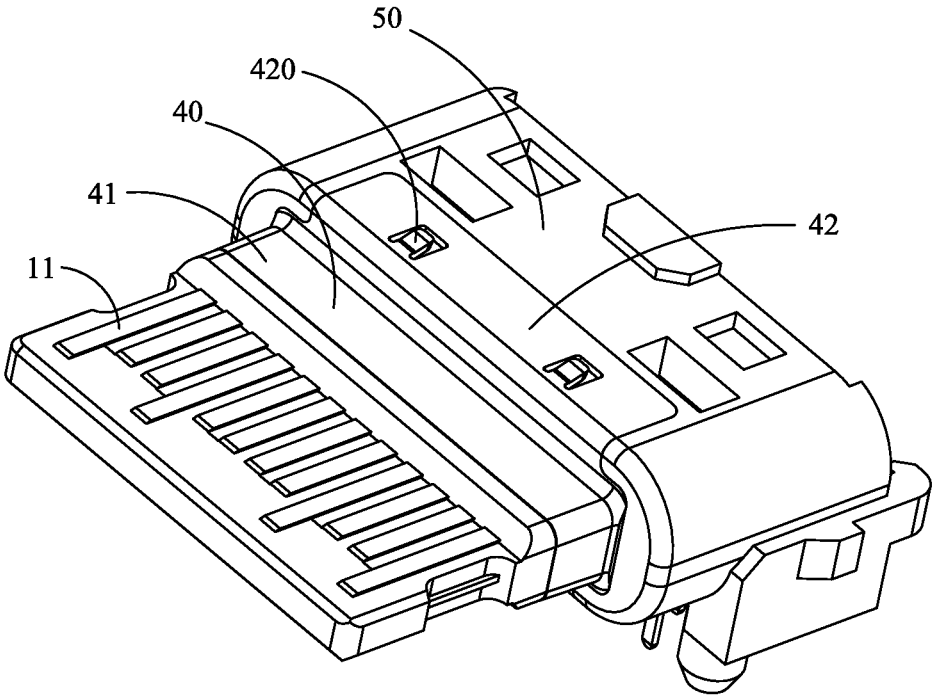
FIG. 8 is a perspective view showing an outer insulative inject-molded over the upper contact module, the lower contact module and the inner shell.
Figure 9:
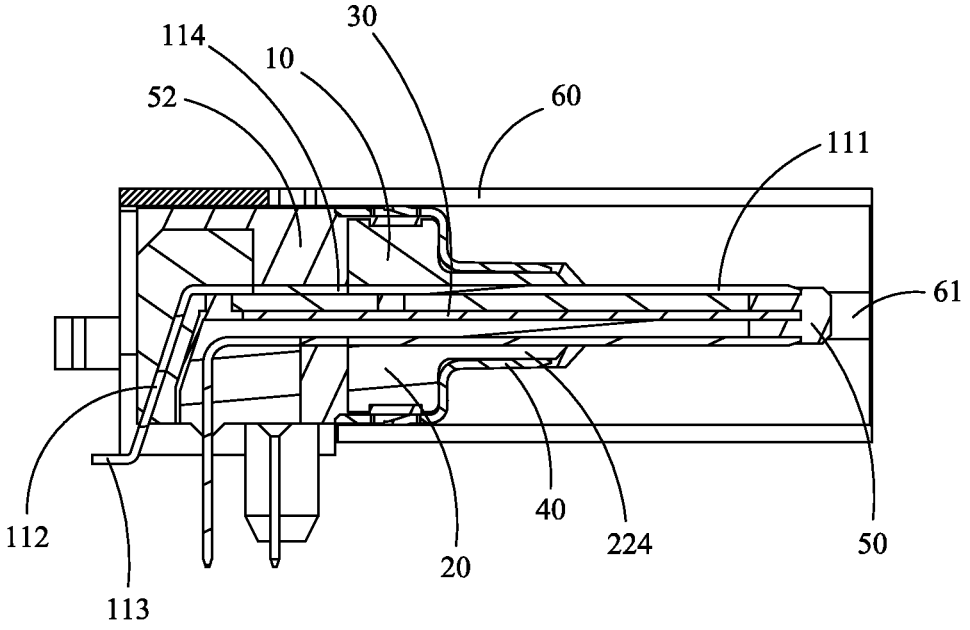
FIG. 9 is a cross-sectional view taken along line A-A of FIG. 1.
Figure 10:
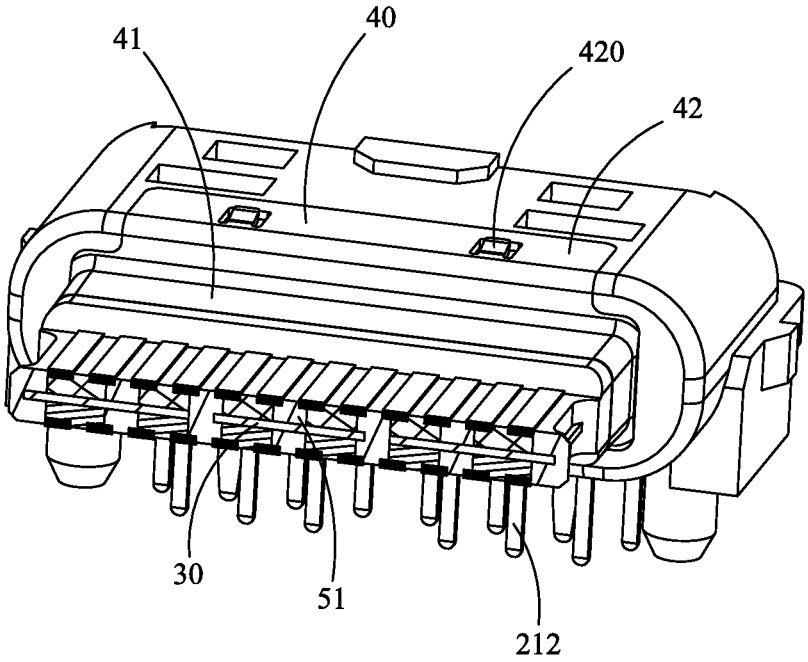
FIG. 10 is a cross-sectional view taken along line B-B of FIG. 1.

The inner shell 40 is attached to a top side of the upper housing 12 and a bottom side of the lower housing 22. As shown in FIG. 7, the deformable protrusions 33 are capable of contacting inner shell 40 for achieving a relative larger grounding area. Besides, the inner shell 40 includes a plurality of elastic tabs 420 for engaging with the outer shell 60. As a result, the shielding plate 30, the inner shell 40 and the outer shell 60 are in series connection with each other.

Referring to FIGS. 3 and 7 to 10, according to the first embodiment of present disclosure, the inner shell 40 is unitary of one piece and includes a first part 41 enclosing the front portions 124, 224 of the upper base 120 and the lower base 220, and a second part 42 enclosing the rear portions 123, 223 of the upper base 120 and the lower base 220. The elastic tabs 420 are formed on the second part 42. The front part 41 is of a rectangular frame configuration. The deformable protrusions 33 of the shielding plate 30 abut against inner sides of the front part 41 to establish connection.

The inner shell 40 covers rear ends of the upper and lower tongue portions 121, 221 so that the roots of the upper and lower tongue portions 121, 221 do not easily get deformed or cracked. The rear portions 123, 223 and the front portions 124, 224 are of a stepped shape for improving the strength of the roots of the upper and lower tongue portions 121, 221 and dispersing the stress. The second part 42 is located in front of the depressions 125, 225 of the upper and the lower bases 120, 220.

The outer shell 60 includes a receiving space 61 for receiving the plug connector. The upper tongue portion 121 and the lower tongue portion 221 are received in the receiving space 61. The upper and the lower tongue portions 121, 221 are located at a center of the outer shell 60 along the vertical direction in order to realize that the plug connector can be inserted into the electrical connector 1 either in the normal insertion or in the reverse insertion. It is understandable that, in order to realize the plug connector can be inserted into the electrical connector 1 either in the normal insertion or in the reverse insertion, the distance between the upper tongue portion 121 and a top wall of the outer shell 60 is the same as the distance between the lower tongue portion 221 and a bottom wall of the outer shell 60.

The outer insulative housing 50 is inject-molded over the upper contact module 10, the lower contact module 20 and the inner shell 40. The outer insulative housing 50 includes a plurality of stuffing blocks filling in the upper slots 126, the middle slots 310 and the lower slots 214, and a plurality of protrusions 52 filling in the depressions 125, 225. As a result, a final integral contact module is formed.

Figure 11:
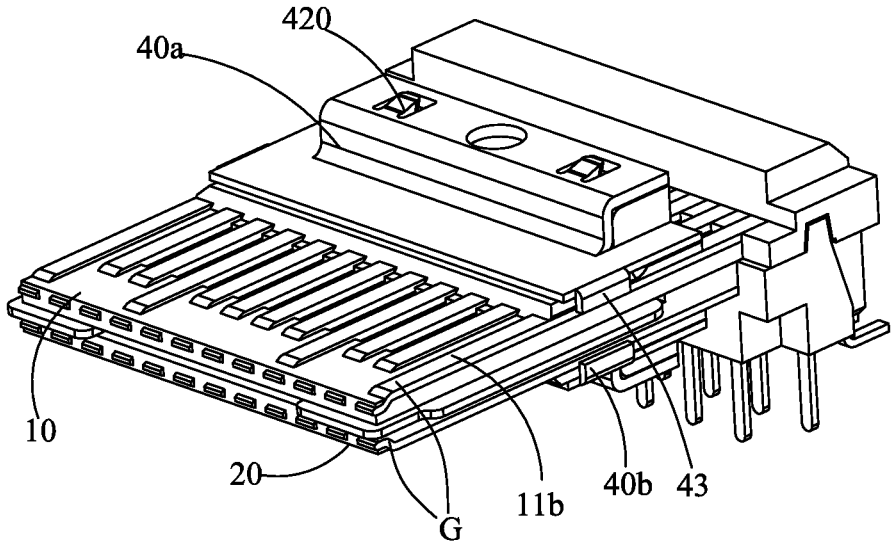
FIG. 11 is a perspective view of an electrical connector in accordance with a second embodiment of the present disclosure showing the relationships of an inner shell, an upper contact module and a lower contact module.
Figure 12:
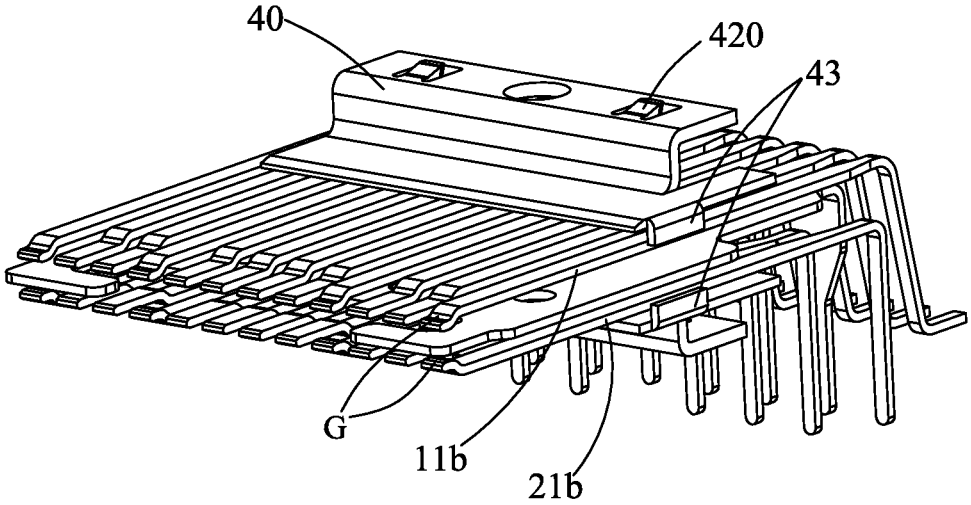
FIG. 12 is a perspective view showing a mating status of the inner shell and corresponding grounding contacts.

FIGS. 11 and 12 discloses another electrical connector 1 which is similar to the first embodiment. The major differences therebetween are the structure of the inner shell 40 and the contacting way between the grounding mechanism and the outer shell 60.

The inner shell 40 includes a top shell 40*a* covering the upper contact module 10 and a bottom shell 40*b* covering the lower contact module 20. The top shell 40*a* and the bottom shell 40*b* are separately made and assembled together. According to the illustrated embodiment of the present disclosure, the top shell 40*a* and the bottom shell 40*b* are separately molded for reducing cost and easy manufacture. The grounding mechanism includes the grounding contacts G located at outmost side of the upper contacts 11 and the lower contacts 21. The top shell 40*a* includes an upper fixing leg 43 extending downwardly to contact the upper grounding contact G/the second contact 11*b*. The bottom shell 40*b* includes a lower fixing leg 43 extending upwardly to contact the lower grounding contact G/the fourth contact 21*b*. As a result, the grounding contacts G are in contact with the inner shell 40. The inner shell 40 and the outer shell 60 are in contact with each other via the elastic tabs 420. As a result, the shielding plate 30, the inner shell 40 and the outer shell 60 are in series connection with each other for achieving a relative larger grounding area.

A method for manufacturing the electrical connector 1 includes the following steps:

providing the upper contacts 11 and then insert molding the upper housing 12 over the upper contacts 11 so as to form the upper contact module 10;

providing the lower contacts 21 and then insert molding the lower housing 22 over the lower contacts 21 so as to form the lower contact module 20;

providing the metallic shielding plate 30 sandwiched between the upper contact module 10 and the lower contact module 20;

providing the inner shell 40 attached to the outside of the upper contact module 10 and the lower contact module 20;

insert molding the outer insulative housing 50 over the inner shell 40 and the upper and the lower contact modules 10, 20; and provide an outer shell 60 enclosing the outer insulative housing 50.

Comparing with prior arts, the present discloses are provided with the inner shell 40 and the grounding mechanism which can not only help to improve the strength of the upper and the lower tongue portions 121, 221, but also improve shielding effect. As a result, the signal transmission quality can be greatly improved. Besides, the electrical connector 1 has multiple insert molding processes, and the upper slots 126, the middle slots 310 and the lower slots 214 can help melt plastic flow therethrough.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector comprising:

an upper contact module comprising a plurality of upper contacts and an upper housing inject-molded with the upper contacts;

a lower contact module comprising a plurality of lower contacts and a lower housing inject-molded with the lower contacts;

an outer insulative housing inject-molded with the upper contact module and the lower contact module;

a shielding mechanism at least partly fixed in the outer insulative housing; and a metallic outer shell enclosing the outer insulative housing; wherein the shielding mechanism and the metallic outer shell are in mechanical contact with each other.

2. The electrical connector as claimed in claim 1, wherein the shielding mechanism comprises a metallic shielding plate sandwiched between the upper contact module and the lower contact module.

3. The electrical connector as claimed in claim 2, wherein the upper contact module comprises an upper slot extending vertically therethrough, the lower contact module comprises a lower slot vertically extending therethrough, and the metallic shielding plate comprises a middle slot vertically extending therethrough, the upper slot, the middle slot and the lower slot being in alignment with each other along a vertical direction, the outer insulative housing being inject-molded over the upper contact module and the lower contact module, the outer insulative housing comprising a stuffing block filling in the upper slot, the middle slot and the lower slot.

4. The electrical connector as claimed in claim 2, wherein the metallic shielding plate comprises a flat body portion positioned between the upper contacts and the lower contacts, the flat body portion comprising a deformable protrusion in contact with the metallic outer shell.

5. The electrical connector as claimed in claim 4, wherein the flat body portion extending sidewardly and frontwardly beyond the upper housing and the lower housing.

6. The electrical connector as claimed in claim 4, wherein the metallic shielding plate comprises a pair of soldering legs extending downwardly from the flat body portion for being soldered to a circuit board.

7. The electrical connector as claimed in claim 2, further comprising a metallic inner shell between the outer insulative housing and the metallic outer shell, the metallic inner shell covering the upper housing and the lower housing, the metallic inner shell comprising an elastic tab engaging with the metallic outer shell.

8. The electrical connector as claimed in claim 7, wherein the upper housing comprises an upper base and an upper tongue portion extending forwardly from the upper base, the upper tongue portion being thinner than the upper base; the lower housing comprising a lower base and a lower tongue portion extending forwardly from the lower base, the lower tongue portion being thinner than the lower base; each of the upper base and the lower base comprising a rear portion and a front portion thinner than the rear portion, the front portion being thicker than the upper tongue portion and the lower tongue portion; the metallic inner shell being of a unitary one piece, the metallic inner shell comprising a first part covering the front portions of the upper base and the lower base, and a second part covering the rear portions of the upper base and the lower base.

9. The electrical connector as claimed in claim 7, wherein the metallic inner shell comprises a top shell and a bottom shell, the top shell and the bottom shell being separately made, the top shell being attached to a top side of the upper housing, and the bottom shell being attached to a bottom side of the lower housing.

10. The electrical connector as claimed in claim 7, wherein the metallic shielding plate comprises a flat body portion positioned between the upper contacts and the lower contacts, the flat body portion comprising a deformable protrusion in contact with the metallic inner shell.

11. An electrical connector comprising:

an upper contact module comprising a plurality of upper contacts and an upper housing inject-molded with the upper contacts, the upper contacts comprising an upper grounding contact;

a lower contact module comprising a plurality of lower contacts and a lower housing inject-molded with the lower contacts, the lower contacts comprising a lower grounding contacts in alignment with the upper grounding contact along a vertical direction;

a metallic shielding plate positioned between the upper contact module and the lower contact module;

a metallic inner shell comprising a top shell attached to the upper housing and a bottom shell attached to the lower housing, the top shell comprising an upper fixing leg extending downwardly to contact the upper grounding contact, and the bottom shell comprising a lower fixing leg extending upwardly to contact the lower grounding contact; and an outer insulative housing inject-molded with the upper contact module, the lower contact module and the metallic inner shell.

12. The electrical connector as claimed in claim 11, wherein the top shell and the bottom shell are separately made.

13. The electrical connector as claimed in claim 11, wherein the metallic shielding plate comprises a flat body portion positioned between the upper contacts and the lower contacts, the flat body portion extending sidewardly and frontwardly beyond the upper housing and the lower housing.

14. The electrical connector as claimed in claim 13, wherein the metallic shielding plate comprises a pair of soldering legs extending downwardly from the flat body portion for being soldered to a circuit board.

15. The electrical connector as claimed in claim 11, wherein the upper housing comprises an upper base and an upper tongue portion extending forwardly from the upper base, the upper tongue portion being thinner than the upper base; the lower housing comprising a lower base and a lower tongue portion extending forwardly from the lower base, the lower tongue portion being thinner than the lower base; each of the upper base and the lower base comprising a rear portion and a front portion thinner than the rear portion, the front portion being thicker than the upper tongue portion and the lower tongue portion.

16. The electrical connector as claimed in claim 12, wherein each of the top shell and the bottom shell comprises a pair of elastic tabs.

17. The electrical connector as claimed in claim 11, wherein each upper contact comprises a slant portion and an upper soldering portion extending from the slant portion, the upper soldering portions being arranged in a single row and coplanar with each other.

18. The electrical connector as claimed in claim 17, wherein the lower contacts comprise lower soldering portions extending along the vertical direction, the lower soldering portions being arranged in two rows.

19. The electrical connector as claimed in claim 18, wherein the upper soldering portions are located at a rear of the lower soldering portions.

* * * * *